US005740582A

United States Patent [19]

Harrelson, II

[11] Patent Number: 5,740,582

[45] Date of Patent: Apr. 21, 1998

[54] CENTRAL VACUUM HOSE STORAGE SYSTEM

[75] Inventor: Clyde W. Harrelson, II, Burgaw, N.C.

[73] Assignee: Vacs America, Inc., Burgaw, N.C.

[21] Appl. No.: 667,436

[22] Filed: Jun. 21, 1996

[51] Int. Cl.[6] ..... B65H 75/34

[52] U.S. Cl. ..... 15/315; 15/314; 15/323; 137/355.16; 137/360

[58] Field of Search ..... 15/314, 315, 323; 137/355.16, 355.2, 355.28, 360

[56] References Cited

U.S. PATENT DOCUMENTS 3,353,996 11/1967 Hamrick .
3,464,859 9/1969 Hamrick .
3,520,725 7/1970 Hamrick .
3,568,240 3/1971 Hamrick .
3,958,297 5/1976 Hukuba et al. .
3,977,037 8/1976 Miyake et al. .
3,998,385 12/1976 Ogle .
4,246,675 1/1981 Costanzo .
5,119,843 6/1992 Keenan .
5,189,753 3/1993 Sousa et al. .
5,402,551 4/1995 Workhoven et al. .
5,430,978 7/1995 Kohler .

*Primary Examiner*—Chris K. Moore
*Attorney, Agent, or Firm*—Rhodes, Coats & Bennett LLP

[57] ABSTRACT

A central vacuum hose storage unit to be positioned between the studs of a wall having upper and lower storage chambers and a reversible hose drive assembly positioned to deploy a vacuum hose from a stored position in the lower chamber outwardly through the upper chamber. The drive assembly includes a pair of spaced drive rollers each including a toothed gear with a central shaft opening, and a hose engaging member secured to the gear, the periphery of the roller members having opposed concave faces together defining a hose receiving nip, and radially extending, equally spaced, flexible hose engaging segments extending transversely across the concave faces, and a reversible drive means operatively connected to both roller gears.

20 Claims, 3 Drawing Sheets

CENTRAL VACUUM HOSE STORAGE SYSTEM

BACKGROUND OF THE INVENTION (1) Field of the Invention

The present invention relates generally to a central vacuum system, especially a central vacuum system of the type used in homes, and in particular to a wall mounted, storage cabinet for housing a vacuum cleaner hose when not in use, and a hose drive assembly for deploying the hose from the cabinet.

(2) Description of the Prior Art

Vacuum systems are comprised of a suction assembly that includes a motorized suction fan and a dust collector, and an elongated hose extending from the suction assembly. The hose, which is cylindrical and flexible, normally terminates in a handle at its distal end to which accessories may be attached. In certain embodiments, known as portable vacuum cleaners, the suction assembly is wheeled so that it can be pulled from place to place by the operator. In order to avoid the difficulty and inconvenience of moving the suction assembly, central vacuum systems have been developed.

Generally, these central vacuum systems are comprised to a permanently located suction assembly, at least one vacuum hose outlet located near the cleaning area, and a conduit connecting the assembly to the outlet. A flexible hose having a connection end and a distal end is releasably attached at its connection end to the outlet when the surrounding area is to be vacuumed. Electrical wiring normally extends from the suction assembly to the outlet and connects with other wiring extending through the hose to a control means in a handle at the distal end of the hose, completing an electrical control circuit.

Central vacuum systems have gained wide popularity and acceptance, particular in homes. However, one continuing annoyance is the need to store the vacuum hose when the system is not being used. Often, the problem is addressed by simply stuffing the hose into an area such as a coat closet, or carrying the hose to a remote area such as a garage. Such solutions are either inconvenient or unsightly.

Various means have been suggested by the prior art to address this problem. For example, the following patents describe central vacuum systems in which the hose is inserted into the conduit joining the suction assembly and the outlet when the hose is not in use:

| | |
|---|---|
| 3,353,996 | Hamrick |
| 3,464,859 | Hamrick |
| 3,520,725 | Hamrick |
| 3,568,240 | Hamrick |
| 5,430,978 | Kohler |

The following patents describe devices including a powered reel to store the hose:

| | |
|---|---|
| 4,246,675 | Costanzo |
| 5,119,843 | Keerian |
| 5,402,551 | Workhoven et al |

U.S. Pat. No. 3,958,297 to Hukuba et al describes a vacuum cleaner comprised of a cabinet having a suction assembly housed in a first chamber and a second compartment for housing a retractable hose. A motorized drive mechanism comprised of a pair of interlocked rollers on opposite sides of the hose is used to extend and retract the hose from the compartment.

U.S. Pat. No. 3,977,037 to Miyake et al describes a similar structure in which a vacuum hose and suction assembly is housed in a piece of furniture. The hose is withdrawn from, and retracted into, the furniture piece by a drive roll engaging the surface of the hose. The drive roll is covered by a cylindrically shaped elastic layer that is axially splined to provide a series of radially inwardly recessed grooves spaced at intervals equal to the spacing of adjacent convolutions on spiral ribs on the hose.

While certain of the above systems provide some improvement over merely dumping the hose in a closet or other area when not in use, several problems still have not been addressed in an economical and practical manner. Storage still requires the presence of an exposed container, e.g., a piece of furniture, or the use of complex conduit mechanisms and electrical circuitry. Also, hose extension and retractions mechanisms described in the prior art do not engage the hose with a grip sufficient to withdraw a coiled hose, which may be thirty feet or more in length from a storage compartment, or retract the hose back into the container.

A storage unit for retractably housing the hose of a central vacuum system that overcomes the above problems would be of considerable advantage and convenience to the home owner. Thus, it is a aspect of the present invention to provide a central vacuum hose storage unit having a hose storage compartment for inconspicuously housing a flexible vacuum hose when not in use, and a hose drive assembly having a construction adequate to withdraw a lengthy vacuum hose from, and returning the hose to, the storage compartment.

In particular, it is an aspect of the present invention to provide a central vacuum hose storage unit that includes a storage compartment that can be positioned between the studs of the wall of a house or other structure, so that the vacuum hose can be retracted into the compartment when not in use and withdrawn therefrom when it is to be used.

Another aspect of the invention is to provide an improved hose drive assembly mounted in the storage compartment and comprised of a pair of facing, oppositely rotated, drive roller positioned to engage opposite sides of the hose, and having facing surfaces corresponding to the hose curvature, so that adequate contact and gripping of the hose is provided.

Other features of the invention will be apparent to one skilled in the art upon a reading of the detailed description of the invention which follows, taken together with the drawings. In the description, terms such as horizontal, upright, vertical, above, beneath and the like are used solely for the purpose of clarity in illustrating the invention, and should not be taken as words of limitation.

SUMMARY OF THE INVENTION

The present invention is directed to a central vacuum system, and in particular to a hose storage unit for a central vacuum system, the unit having a storage compartment that can be positioned between the studs of a wall, such as the wall of a residence, and a drive assembly for withdrawing a hose from, and returning a hose to, the storage compartment.

The hose storage unit forms a part of a central vacuum system, that also includes a suction assembly, and a flexible vacuum hose. The suction assembly comprised of a motorized suction fan, a filter, and a dust collector, may be one of several types commercially available, and need not be described in detail. The hose is also of a commercially available construction, and is essentially a flexible tube that may be reinforced with a wire spiral about its outer surface, providing the appearance of ridges on the tube surface. Electrical wiring may also extend through the hose for one end to the other, so that the vacuum system electrical circuitry can include switches on a handle at the distal end of the hose.

The storage compartment of the hose storage unit of the present invention is of a cubical configuration, with spaced, vertical side walls, a rear wall joining the side walls, a top wall, a bottom wall, and a front wall. Sections of the front wall may be hinged to form one or more access doors into the compartment.

The storage compartment is preferable divided into an upper chamber and a lower chamber by an divider wall extending horizontally across the compartment between the side walls, and intermediate the top and bottom walls. A section of 2×4 having the same dimensions as the studs may be used to construct the divider wall. In the preferred embodiment, the compartment is permanently installed in the wall of a residence. Therefore, in this embodiment, the walls may be formed of parts of the wall frame and covering. For example, the side walls can be adjacent studs of the wall, and the back wall can be the dry wall of a room behind the studs.

Alternatively, the storage compartment can be constructed as a freestanding unit and installed between the studs. In this case the distance between the outside surfaces of the compartment side walls with be equal to the distance between the facing surfaces of adjacent studs. The depth of the compartment is preferably equal to the depth of the studs, e.g., 3.5 inches in the case of regular studs. However, a deeper unit that projects either from the front, or from the back, of the wall in which it is installed is also contemplated by the present invention. In referring to "walls" in the present description, it is to be understood that both types of walls are contemplated. Also, a wall component, e.g., a stud, can serve as part of a wall, while another part of the wall is separately constructed.

As noted above, the compartment preferably includes an upper chamber and a lower chamber, with the chambers being separated by a divider wall. In this configuration, the upper chamber serves as a container for the upper end of the hose, which normally terminates in a handle, and for accessories that are to be attached to the hose. Clips may be provided to secure the handle and accessories to a wall, e.g., the back wall, of the upper chamber. The front wall over the upper chamber will normally be in the form of a door, hinged at one side of the chamber, providing ready access to the hose handle and accessories.

The lower chamber is essentially of a box-like configuration. Normally, the side wall will be formed of adjacent studs, and the bottom wall will be a horizontal member of the wall. The top wall will be formed from the lower side of the dividing wall. The dividing wall includes an opening with a diameter at least as large at the diameter of the hose, so that a hose stored in the lower chamber can be withdrawn into and through the upper chamber.

An outlet is also mounted in a wall of the lower chamber to connect the inner, connector end of the hose to a suction device, either directly or through a conduit. The present invention also contemplates positioning of the suction device in a third chamber, e.g., a chamber located beneath the chamber used to store the hose.

The storage unit also includes a powered, hose drive assembly to withdraw a hose from the hose storage compartment, and to return the hose to the compartment after use. Preferably the assembly is contained within a housing mounted on the divider wall adjacent the divider wall opening. As will be noted in the description of the preferred embodiment, mounting of the drive assembly on the lower side of the divider wall so that the assembly is enclosed in the hose storage chamber is preferred.

The construction of the drive assembly is an important aspect of the present invention, since the operability of the system depends upon the ability of the assembly to extend and retract the flexible vacuum hose, which is heavy, unwieldy, and difficult to grip with rollers.

The hose drive assembly is comprised of first and second opposed hose drive roller supported on parallel shafts with the peripheries of the roller facing each other at a predetermined distance, which is slightly less than the diameter of the hose to be manipulated, so that the roller faces snugly engage the hose surface. The periphery of each roll is concave in configuration. For example, the surface may be in the shape of an arc of a circle corresponding to the outer circumference of the hose. Together, the roll faces defining a hose receiving nip.

In order to improve the grip on the hose, the roller may further include hose gripping projections extending from said concave faces. These projections extend radially outward and transversely across said concave faces, and may be integrally formed of the same material as the roll. For example, the entire roll may be formed of rubber or a flexible plastic material.

The drive assembly also includes a drive means for reversibly rotating the roller in opposite directions to draw the hose through the roll nip in the direction desired. The drive means may be comprised of an a power source, normally an electric motor, and gears connecting the chive means to the roller. Importantly, both roller are connected to the drive means, instead of one roll merely being an idler roll, since it has been found that gripping of the hose on opposite side by powered roller in necessary to achieve the force necessary to manipulate the hose.

In order to drive both roller, each drive roll may comprise a gear having a central shaft opening and gear teeth about its periphery. A cylindrical annular shoulder may extend outwardly from one side of the gear, so that an annular hose engaging member can be secured around the shoulder. This annular hose engaging member can be formed with a concave face of the configuration described above to engage the hose. The gear will be formed of a rigid material, e.g., metal, and the hose engaging member may be formed of a flexible material.

Power from electric motor is transferred to the drive roller through one or more transmission gears connecting the motor shaft to the roller. For example, a worm gear can be mounted on the motor shaft, and a transfer gear can be positioned between the worm gear and one of the drive roll gears. The gear teeth of one drive roll gear can then mesh with the gear teeth of the other drive roll gear, so that power is transferred to both roller. Since the roll gears are interconnected, and since the roller have the same diameter, the roll faces will turn at the same surface speed.

Several optional features can be included in the above drive assembly. For example, a pivotal mount can be used to support one to the drive roller, so that the roll can be pivoted from its hose engaging position to a hose release position in the event of a malfunction. A mount release lever can be used to normally hold the roll in the hose engaging position. Also, the electrical circuitry can include a switch to open the circuit when the torque on the motor exceeds a predetermined value, e.g. when the hose becomes jammed. An embodiment of an inexpensive torque release switch actuated by a moveable motor is illustrated in the description of the preferred embodiment.

Hose guides are also provided to accurately position the hose within the roller nip. Preferably, first and second spaced hose guides are provided, with each guide having a hose receiving orifice or channel. The orifices lie in spaced parallel planes, and are axially aligned, so that a pathway is defined along the axis of the orifices. The nip of the rollers is also axially aligned along this pathway, so that a hose in carded in a straight line through the guides and nip.

DETAILED DESCRIPTION OF THE INVENTION

Figure 1:
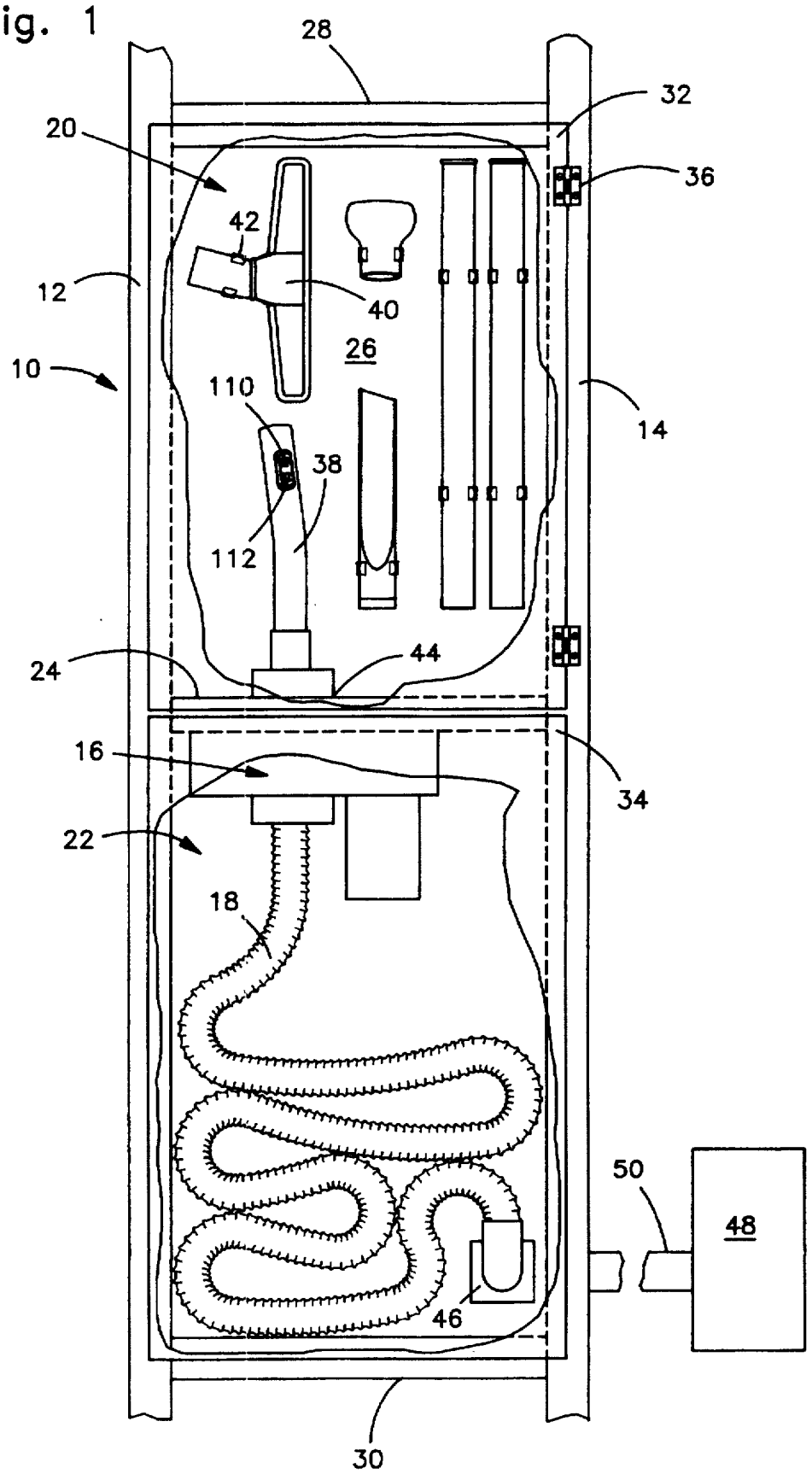
FIG. 1 is a plan view of the storage unit of the invention, including the storage compartment and the hose drive assembly.
Figure 2:
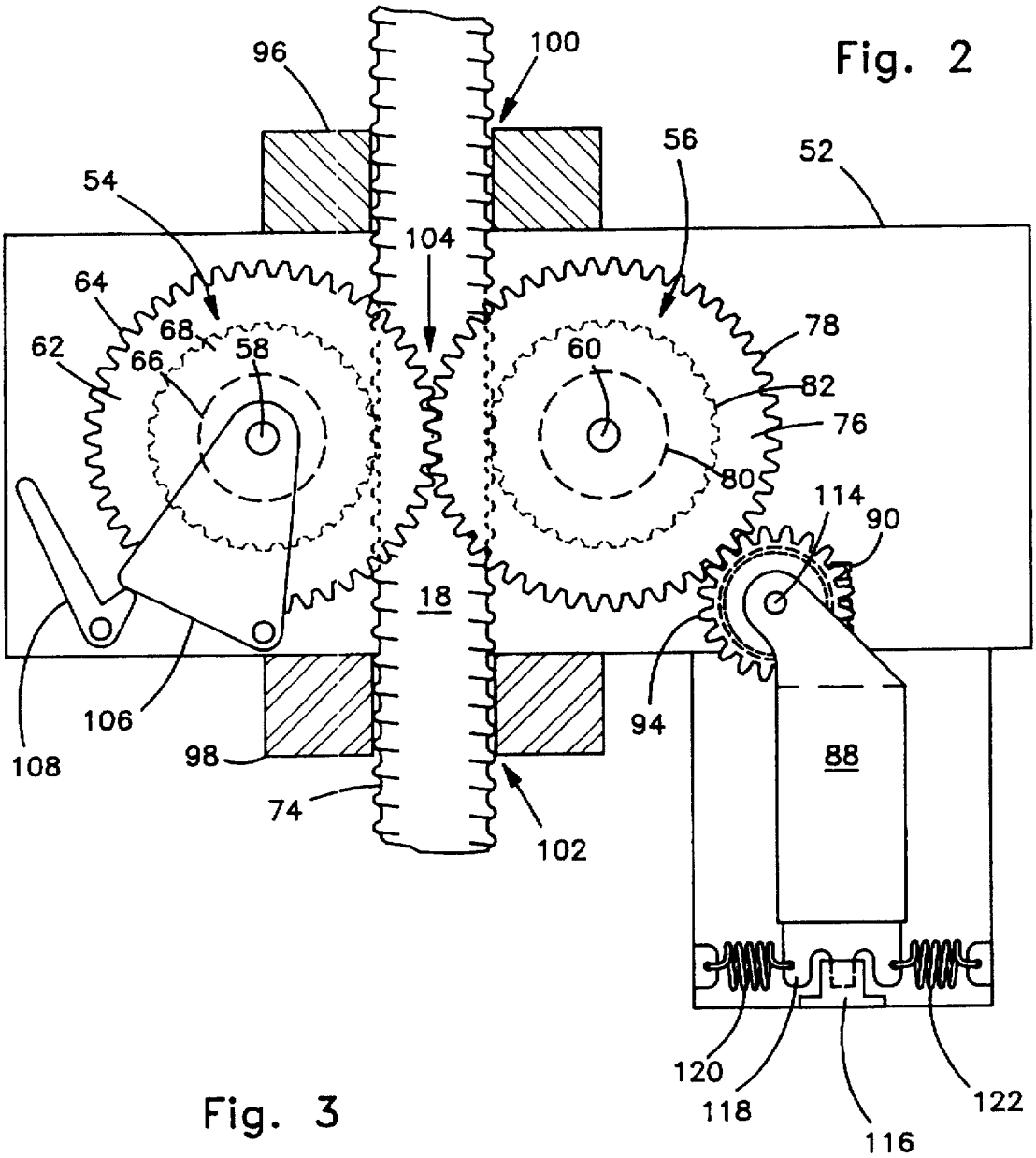
FIG. 2 is a detailed view of the hose drive assembly.
Figure 3:
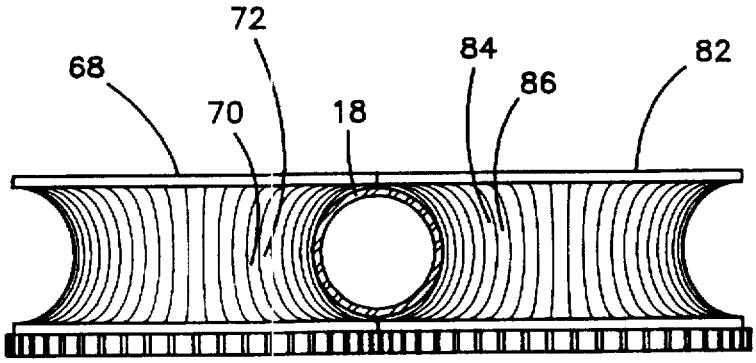
FIG. 3 is a top view of the rollers of the drive assembly.

As best shown in FIG. 1, the preferred embodiment of the present invention is comprised of a storage compartment, generally 10, constructed between studs 12 and 14 of a wall. A hose drive assembly 16, shown in detail in FIGS. 2 and 3, is positioned within compartment 10 to withdraw and return a hose 18.

Storage compartment 10 is comprised an upper chamber, generally 20, and a lower chamber, generally 22, separated by a divider wall 24. The side walls of chambers 20 and 22 are formed by studs 12 and 14. A common rear wall 26 extends across the back of chambers 20 and 22. Compartment 10 also includes a top wall 28 and a bottom wall 30. A front wall 32 extends across chamber 20, and a front wall 34 extends across chamber 22. Front walls 32 and 34 are shown cut-away to expose the interior of their respective chambers. Front wall 32 may be hinged at hinges 36 to form an access door into the chamber 20. Similarly, front wall 34 may be hinged, or removably attached to provide access into chamber 22.

Upper chamber 20 serves as a storage compartment for the upper end of hose 18, terminating in handle 38, and for accessories 40. Clips 42 may be provided to secure handle 38 and accessories 40 to rear wall 26.

Divider wall 24 includes a hose opening 44 having a diameter at least as large as the diameter of hose 18, so that hose 18 can be withdraw from chamber 22 into and through chamber 20. An outlet 46 is mounted in the wall of chamber 22 to connect the inner end of hose 18 to suction device 48, through a conduit 50.

As best shown in FIG. 2, hose drive assembly 16 is comprised of a housing 52 enclosing first and second opposed hose drive rollers 54 and 56 supported on parallel shafts 58 and 60, respectively, so that the outer edges of their hose engaging surfaces face each other at a predetermined distance. Roller 54 is formed of a gear 62 having gear teeth 64 about its periphery, and a cylindrical annular shoulder 66 that extends outwardly from one side about shaft 58. An annular hose engaging member 68 is secured around shoulder 66. Member 68 can be formed with a concave face 70, having transverse hose engaging projections 72 equally spaced around its periphery. Projections 72 may be integrally formed with member 68, and are adapted to fit within valleys 74 on hose 18. In the event hose 18 becomes slightly unsynchronized, or if valleys 74 are slightly less than equally spaced, projections 72 will flex upon engagement with hose 18 to adjust for the difference.

Roller 56 is similarly constructed of gear 76 having gear teeth 78 about its periphery, and a cylindrical annular shoulder 80 extending outwardly from one side of gear 76 about shaft 60. An annular hose engaging member 82, secured around shoulder 80, includes concave face 84, with transverse hose engaging projections 86 equally spaced around its periphery.

Rollers 54 and 56 are driven by electric motor 88 communicating with gears 62 and 76 by way of worm gear 90 and transfer gear 94. Motor 88 in wired into an electrical circuit so that gear 90 can be rotated in either direction to reversibly rotate rollers 54 and 56 in opposite directions.

Spaced hose guides 96 and 98 are positioned on either side of rollers 54 and 56 and include orifices 100 and 102, respectively, positioned along a vertical pathway extending through the center of nip 104 to accurately position hose 18. As shown, guides 100 and 102 are made of a smooth non-abrasive material, such as nylon. However, the guides can also be made of metal, or can be in the form of idler rollers.

Drive roller 54 is supported on a pivotal mount 106 so that roller 54 can be pivoted from its hose engaging position to a hose release position in the event of a malfunction. Release lever 108 normally holds roller 54 in the hose engaging position.

Figure 4:
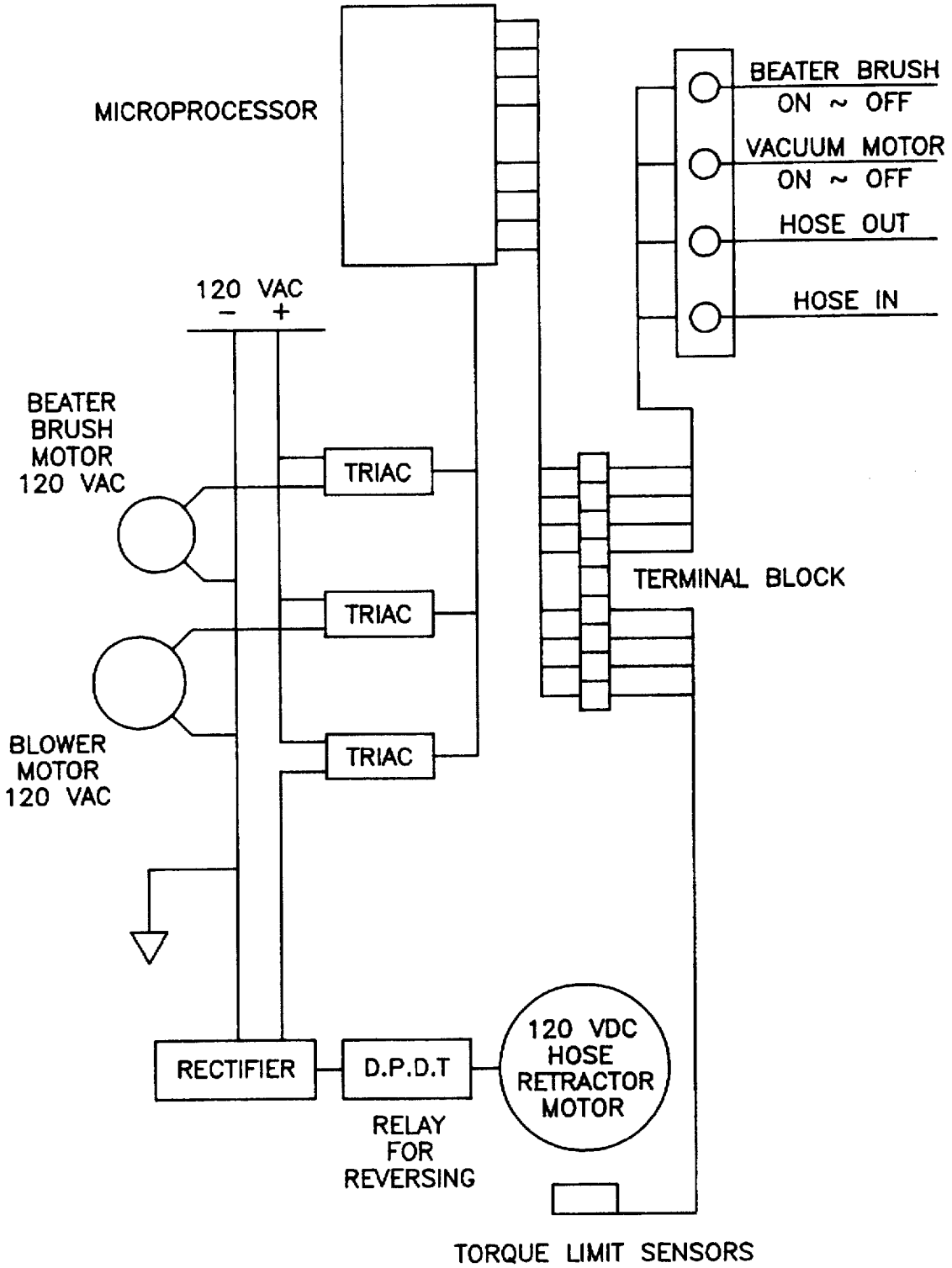
FIG. 4, is a schematic of the electrical circuitry of the invention.

An electrical circuit, shown schematically in FIG. 4, joins motor 88 to drive control switch 110 in handle 38. Switch 110 includes forward, off and back positions, so that the operator can activate the drive assembly to extend or retract hose 18. In addition, the circuitry include a switch 112 to activate suction device 48.

Motor 88 is pivotally mounted on transfer gear shaft 114. In the event that the gearing jams, e.g., as a result of binding of hose 18, gear 78 will remain stationary, while gears 90 and 94 will continue to turn. As a result, motor 88 will be caused to pivot about shaft 114. A sensor switch 116 is also positioned in the electrical circuitry including motor 88. Switch 116 is of the type that emits a light that is reflected back to the sensor, and remains closed as long as light is reflected. A reflective flag 118 is mounted on the bottom of motor 88 and normally reflects light back to sensor 116. However, when there is a malfunction, causing motor 88 to pivot from its normal position, flag 118 is moved out of position, opening switch 116. When the malfunction is corrected, motor 88 is urged back to its normal position by springs 120 and 122.

In operation, hose 18 is positioned in chamber 22 with its inner end connected to outlet 46 and its upper end, carrying handle 38 extending into chamber 20. Hose 18 extends along a pathway through guide 98, nip 104 and guide 96. When system is to be used, the operator grasps handle 38 and moves switch 110 to its forward position, causing motor 88 to rotate rollers 54 and 56 so that their inner faces move toward chamber 22. Members 68 and 82 firmly engage the outer surface of hose 18 with projections 72 and 86 extending into valleys 74, withdrawing hose 18 from chamber 22 and deploying hose 18 through chamber 20 out of the storage unit. When hose 18 has been deployed to the desired length, the operator moves switch 110 to its off position. The operator then moves switch 112 to the on position to begin vacuuming.

When vacuuming is completed, the operator moves switch 112 to the off position, and moves switch 110 to its back position, causing motor 88 to rotate rollers 54 and 56 in the opposite direction so that their inner faces move away from chamber 20, returning hose 18 into its stored position in chamber 22.

Certain modifications and improvements will occur to those skilled in the art upon a reading of the foregoing description. It should be understood that all such modifications and improvements have been deleted herein for the sake of conciseness and readability but are properly within the scope of the follow claims.

What is claimed is:

1. An apparatus for extending and retracting a vacuum cleaner hose comprising:

a) first and second spaced hose guides, said guides having axially aligned hose receiving orifices;

b) first and second opposed hose drive rollers, said rollers having concave faces together defining a hose receiving nip axially aligned with the orifices of said guides;

c) drive means for reversibly rotating said rollers in opposite directions; and (d) a pivotable mount supporting said first drive roller, and a mount release, whereby said roller is pivotable between an engaged position and a release position.

2. The apparatus of claim 1, wherein said rollers further include hose gripping projections extending from said concave faces.

3. The apparatus of claim 2, wherein said projection extend radially outward and transversely across said concave faces.

4. The apparatus of claim 2, wherein said projections are flexible.

5. The apparatus of claim 1, wherein said drive means is comprised of an electric motor, and gear wheels connecting said motor to said first and second drive rollers.

6. The apparatus of claim 1, wherein said first and second drive rollers are each comprised of a gear having a central shaft opening, gear teeth about its periphery and an cylindrical annular shoulder extending outwardly from one side of said gear, and an annular hose engaging member secured about said shoulder, the periphery of said member having a concave face.

7. The apparatus of claim 6, wherein said gear is formed of a rigid material, and said member is formed of a flexible material.

8. The apparatus of claim 6, wherein the gear teeth of the first roller mesh with the gear teeth of the second roller.

9. The apparatus of claim 6, wherein each member further includes radially extending, equally spaced, flexible hose engaging segments extending transversely across said concave face.

10. The apparatus of claim 1, wherein said hose has a given outer diameter, and the distance between the faces of said drive rollers is less than said given diameter.

11. A hose storage unit for storing a vacuum hose in a wall having adjacent studs comprising:

a) first and second storage chambers positioned between adjacent studs of a wall;

b) a divider wall extending between said studs and separating said chambers; and c) a reversible hose drive assembly positioned to move said hose from a stored position in said first chamber outwardly through said second chamber.

12. The unit of claim 11, further including hose guides on opposite sides of said drive assembly to guide said hose through said assembly.

13. The unit of claim 11, wherein said drive assembly includes a pair of hose drive rollers between said guides, said rollers having opposed concave faces together defining a hose receiving nip.

14. The unit of claim 13, wherein said drive rollers include radially extending, equally spaced, flexible hose engaging segments.

15. The apparatus of claim 14, wherein said hose engaging segments extend transversely across said concave faces.

16. The apparatus of claim 12, wherein said drive assembly includes an electric motor having a shaft, said first and second drive rollers include meshing gears, and an intermediate gear engaging one of said meshing gears and said motor shaft.

17. The apparatus of claim 16, wherein said drive means further includes a release switch to deactivate said motor when a predetermined torque on said motor is incurred.

18. The unit of claim 11, further including a third chamber for housing a suction device.

19. The unit of claim 11, further including a door to provide access into said second chamber.

20. An apparatus for extending and retracting a vacuum cleaner hose comprising:

a) first and second spaced hose guides, said guides having axially aligned hose receiving orifices;

b) first and second opposed hose drive rollers, said rollers having concave faces together defining a hose receiving nip axially aligned with the orifices of said guides; and c) drive means for reversibly rotating said rollers in opposite directions, said drive means including a motor and a release switch to deactivate said motor when a predetermined torque on said motor is incurred.

* * * * *